United States Patent [19]

Yoshida et al.

[11] 4,354,905

[45] Oct. 19, 1982

[54] METHOD FOR THE ELECTROLYSIS OF AN AQUEOUS SOLUTION OF AN ALKALI METAL CHLORIDE AND AN ANODE THEREFOR

[75] Inventors: Mitsuo Yoshida; Hiroyoshi Matsuoka, both of Nobeoka, Japan

[73] Assignee: Asahi Kasei Kogyo Kabushiki Kaisha, Osaka, Japan

[21] Appl. No.: 253,664

[22] Filed: Apr. 13, 1981

[30] Foreign Application Priority Data

Apr. 15, 1980 [JP] Japan ..... 55-48634
Dec. 10, 1980 [JP] Japan ..... 55-173126

[51] Int. Cl.[3] ..... C25G 1/34; C25G 11/03; C25G 9/00; C25G 11/08

[52] U.S. Cl. ..... 204/98; 204/128; 204/258; 204/266; 204/284; 204/283

[58] Field of Search ..... 204/98, 128, 283, 284, 204/258, 266

[56] References Cited

U.S. PATENT DOCUMENTS 4,100,050 7/1978 Cook, Jr. et al. .
4,105,514 8/1978 Justice et al. ..... 204/98
4,108,742 8/1978 Seko et al. .

*Primary Examiner*—R. L. Andrews
*Attorney, Agent, or Firm*—Birch, Stewart, Kolasch & Birch

[57] ABSTRACT

The use of a perforated plate anode in combination with a cation exchange membrane has been found to be extremely effective for rendering the current distribution in the cation exchange membrane uniform in practice of the ion exchange membrane process for the electrolysis of an aqueous solution of an alkali metal chloride. The uniform current distribution in the cation exchange membrane is, in turn, effective for preventing elevation of the electrolytic voltage and prolonging the life of the cation exchange membrane. Further, when the coating of the perforated plate anode on its front surface and the inner wall surfaces of the openings has a thickness larger than that of the coating on the back surface, the perforated plate anode has high durability and exhibits low electrolytic voltage for a long time as compared with the perforated plate anode having, on each surface, a uniform-thick coating.

19 Claims, 1 Drawing Figure

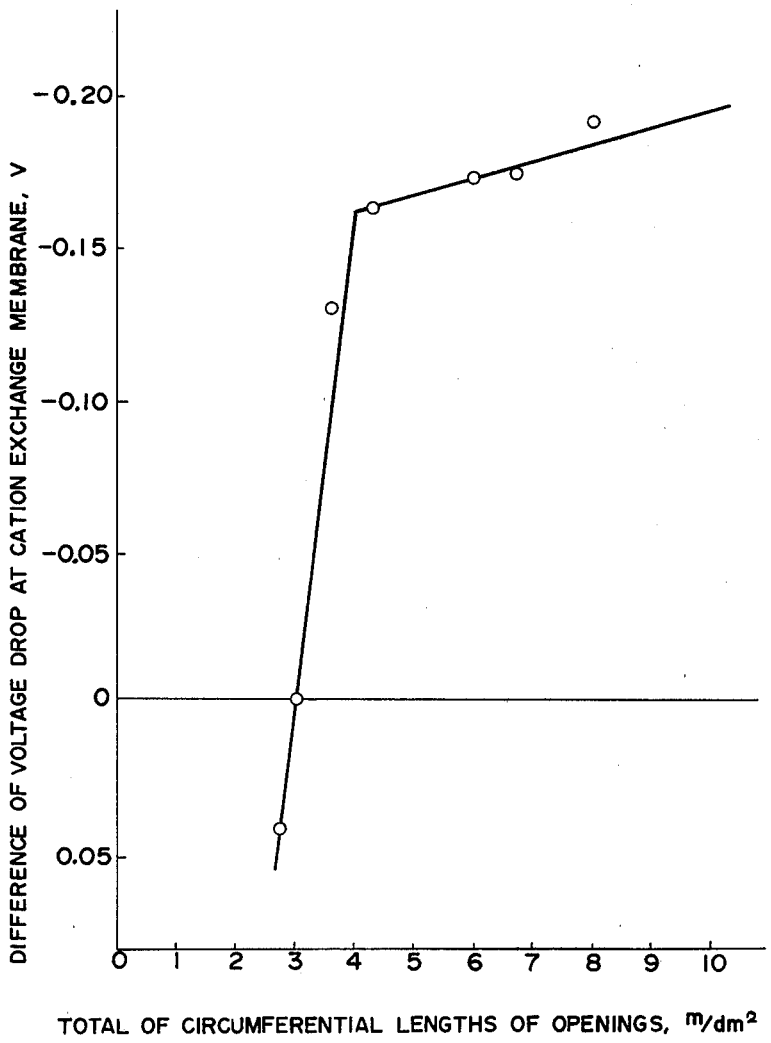
-0.20
-0.15
-0.10
-0.05
0
0.05
DIFFERENCE OF VOLTAGE DROP AT CATION EXCHANGE MEMBRANE, V
0
1
2
3
4
5
6
7
8
9
10
TOTAL OF CIRCUMFERENTIAL LENGTHS OF OPENINGS, m/dm²

METHOD FOR THE ELECTROLYSIS OF AN AQUEOUS SOLUTION OF AN ALKALI METAL CHLORIDE AND AN ANODE THEREFOR

BACKGROUND AND SUMMARY OF THE INVENTION

This invention relates to a method for the electrolysis of an aqueous solution of an alkali metal chloride and an anode therefor. More particularly, the present invention is concerned with a method for the electrolysis of an alkali metal chloride which comprises conducting electrolysis of an aqueous alkali metal chloride in an electrolytic cell partitioned by means of a cation exchange membrane into an anode chamber and a cathde chamber, using a perforated plate anode in the anode chamber, and also is concerned with a perforated plate anode therefor which not only provides a low electrolytic voltage but also has a high durability.

An electrolytic process of an aqueous solution of an alkali metal chloride in which process a cation exchange membrane is used is gaining attention in the art, because this ion exchange membrane process is useful not only for overcoming the various drawbacks accompanying the two conventional processes for the electrolysis of an aqueous solution of an alkali metal chloride, namely, the mercury process and the diaphragm process, but also for saving energy. The noticeable features of the ion exchange membrane process are that neither mercury nor asbestos is used and therefore there is no fear of environmetal pollution, the cation exchange membrane used is capable of preventing the aqueous solution of an alkali metal chloride from diffusion from the anode chamber to the cathode chamber and therefore the purity of the alkali metal hydroxide produced is high, and the electrolytic cell is completely partitioned by means of a cation exchange membrane into an anode chamber and a cathode chamber and therefore the purity of each of the chlorine gas and the hydrogen gas produced is high. Further, the total energy cost as calculated from electric power and vapor, for example that in the electrolysis of an aqueous solution of sodium chloride, is lower than that in each of the mercury process and the diaphragm process. However, the rate of the cost of electric power in the proportionally variable cost in the total production cost is still high and is as high as about 40% in Japan. Taking into consideration the increasing price of petroleum oil in the future, the demand for the development of a new technique useful for lowering the consumption of electric power is increasing more and more in the art.

The anode currently used for the electrolytic method of an aqueous solution of an alkali metal chloride is mainly a metallic anode comprising a metal substrate of titanium or the like and a coating coated on the surface of said metal substrate, said coating being composed mainly of a precious metal oxide such as ruthenium oxide or the like. In the technical field of an anode, it is known that in electrolysis of an aqueous solution of an alkali metal chloride there is used an anode of a gas-removing structure in order to avoid elevation of the electrolytic voltage due to current shielding caused by the chlorine gas generated on the anode. In this known technique, such an anode of a gas-removing structure is devised so that the chlorine gas generated on the anode can readily escape from the anode chamber behind the anode with respect to the position of the cathode. Representative examples of such anode structure conventionally employed include an assembled structure in which a plurality of round metal rods each having a diameter of 2 to 6 mm are arranged in parallel at an interval of 1 to 3 mm and an expanded metal structure produced from a thin metal plate having a thickness of 1 to 2 mm.

In electrolyzing an aqueous solution of an alkali metal chloride by the mercury process using an anode of the gas-removing structure, the structural characteristics of the gas-removing structure have substantially no influence on the electrolytic voltage because there is present only an aqueous solution of an alkali metal chloride of low electrical resistance between the anode and the cathode as different from the present process using a cation exchange membrane having a relatively high electrical resistance. In the case of the diaphragm process, the asbestos diaphragm is pressed against the cathode. Further, the asbestos diaphragm is not selectively permeable to ions as different from the cation exchange membrane and, hence, there is not formed a desalted layer of high electrical resistance between the anode and the asbestos diaphragm. For the reasons stated above, also in the case of the diaphragm process, the structural characteristics of the anode have substantially no influence on the electrolytic voltage. Further, in the diaphragm process, there is generally employed a current density as low as 20 $A/dm^2$. Furthermore, in the diaphragm process, there is generally employed, as an anode structure, the so-called expanded metal structure rather than the perforated structure produced by holing a thin plate having a thickness of 1 to 3 mm because the expanded structure can be produced at low cost due to the reduction in quantity of the titanium substrate material required. In industrial practice, there is usually employed an expanded metal anode which is produced by forming 10 to 30 mm—long cuts in a 1 to 2 mm—thick titanium plate, followed by 1.5 to 3 times expansion.

As different from the above-mentioned conventional two processes, in the ion exchange process, due to the selectivity to cations of the cation exchange membrane, the cation transport number in the cation exchange membrane is larger than that in the electrolytic solution in the anode chamber. For this reason, there is formed a desalted layer over the surface of the cation exchange membrane on the side of the anode. The desalted layer is extremely high in electrical resistance. Therefore, as proposed in Japanese Patent Application Laid-Open Specification No. 68477/1976, the electrolysis is conducted while maintaining the inner pressure of the cathode chamber at a level higher than that of the anode chamber so that the spacing between the anode and the cation exchange membrane can be reduced. The reduction of the spacing between the anode and the cation exchange membrane serves not only to lower the electrolytic voltage as the effect of said reduction itself, but also causes the desalted layer to be continuously, forcibly agitated by the action of the chlorine gas generated on the anode so that the thickness of the desalted layer can be considerably reduced, leading to further lowering of the electrolytic voltage. However, in the ion exchange process, there still remains unresolved such a problem that the current distribution in the cation exchange membrane often tends to be non-uniform so that the occasional elevation of electrolytic voltage and the deterioration of the cation exchange membrane for a short period of time cannot be avoided.

With a view to developing a new method overcoming the above-mentioned disadvantages, the inventors of the present invention have made extensive and intensive investigations. More specifically, the inventors have made such an investigation that the ion exchange process is carried out by adding a small amount of ions of radioactive isotope $Ca^{45}$ to the electrolytic solution in the anode chamber to determine the distribution of $Ca^{45}$ ions in the cation exchange membrane at the time when the $Ca^{45}$ ions pass through the cation exchange membrane, together with the alkali metal ions. As a result, it has been found that not only the distribution of the $Ca^{45}$ ions in the ion exchange membrane, that is, the current distribution in the ion exchange membrane but also the electrolytic voltage widely varies heavily depending on the structure of the anode. It has also been found that when the anode having, on its surface, convex and concave portions such as the conventional expanded metal anode is used, only the convex portions of the anode are contacted with the cation exchange membrane and therefore the current is caused to be concentrated only in the portions of the cation exchange membrane which correspond to the convex portions of the anode. Consequently, the current distribution in the cation exchange membrane becomes non-uniform, leading to not only elevation of the electrolytic voltage but also acceleration of deterioration of the cation exchange membrane. For obviating such drawbacks, it is advantageous to employ a flat type anode. However, with the simple flat type anode, it is impossible to remove the chlorine gas generated on the anode from the anode chamber behind the anode with respect to the position of the cathode, leading to elevation of the electrolytic voltage. Thus, it has been found that, in the ion exchange membrane process, the perforated plate anode is effective for obviating all the drawbacks as mentioned above. The present invention has been made based on such novel findings.

Accordingly, it is one and a primary object of the present invention to provide a method for the electrolysis of an aqueous solution of an alkali metal chloride in an electrolytic cell partitioned by means of a cation exchange membrane into an anode chamber and a cathode chamber, which enables the current distribution in the cation exchange membrane to be extremely uniform, thereby not only avoiding elevation of the electrolytic voltage but also prolonging the life of the cation exchange membrane.

It is another object of the present invention to provide a perforated plate anode for use in a method of the above character, which not only provides low electrolytic voltage but also has high durability.

The foregoing and other objects, features and advantages of the present invention will be apparent to those skilled in the art from the following detailed description taken in connection with the accompanying drawing in which:

The FIGURE is a graph showing the relationship between the total of the circumferential lengths of the openings of the perforated plate anode employed in the method of the present invention and the difference of voltage drop at the cation exchange membrane.

Essentially, in one aspect of the present invention, there is provided a method for the electrolysis of an aqueous solution of an alkali metal chloride, characterized in that the electrolysis is conducted in an electrolytic cell partitioned by means of a cation exchange membrane into an anode chamber and a cathode chamber, using a perforated plate anode in the anode chamber.

In the present invention, the term "perforated plate" is used to mean a plate having openings of such a shape as circle, ellipse, square, rectangle, triangle, rhomb, cross or the like. Such a plate as is produced by subjecting an expanded metal having convex and concave portions to pressing to have a flat shape is also included in the meaning of the perforated plate to be used in the method of the present invention. The spirit of the present invention resides in that, in the so-called ion exchange membrane process, the perforated plate anode is used in combination with the cation exchange membrane so that the inherent drawbacks of the use of the cation exchange membrane are effectively overcome without any sacrifice of the great advantages derived from the use of the cation exchange membrane.

In the perforated plate anode employed in the method of the present invention, removal of the chlorine gas and supply of the alkali metal ions into the interface between the anode and the cation exchange membrane occur most readily in the vicinity of the circumference of the opening and, therefore, the current also runs most readily in the vicinity of the circumference of the opening of the perforated plate. For this reason, it is preferred that the total of the circumferential lengths of the openings be large.

The term "total of the circumferential lengths of openings" often used herein is defined as a value obtained by dividing the total of the circumferential lengths of the openings formed in the perforated plate anode at its portion opposite to the cation exchange membrane by the total area of said portion including the area of said openings, and expressed in terms of $m/dm^2$. The term "opening rate" has the same meaning as generally used, and means the proportion of the total area of openings of the perforated plate anode at its portion opposite to the cation exchange membrane in the total area of said portion including the total area of openings.

Referring to the FIGURE, the abscissa represents the total of the circumferential lengths of the openings formed in the perforated plate anode, and the ordinate represents the difference of voltage drop at the cation exchange membrane, namely, the value obtained by subtracting the voltage drop at the cation exchange membrane at the time when the expanded metal anode is used from the voltage drop at the cation exchange membrane at the time when the perforated plate anode is used. In the experiments for preparing the graph of the FIGURE, the cation exchange membrane was a two-layer laminate of a polymer having an equivalent weight of 1090 and having a woven fabric of Teflon (registered trade mark) embedded therein and a polymer having a equivalent weight of 1350. The polymer having an equivalent weight of 1350 had, only in its surface layer, carboxylic acid groups while the interior of the polymer had sulfonic acid groups. The polymer having an equivalent weight of 1090 contained only sulfonic acid groups. Equivalent weight is the weight of dry polymer in grams which contains one equivalent of ion exchange groups. The expanded metal anode was prepared from a thin plate of a thickness of 1.5 mm, and had a short axis of 7 mm and a long axis of 12.7 mm. Into the anode chamber was supplied a 3 N aqueous solution of sodium chloride having a pH value of 2. Into the cathode chamber was supplied a 5 N aqueous solution of sodium hydroxide. The electrolysis was conducted at a current density of 50 $A/dm^2$ and at 90° C. With respect to the above-mentioned experiments, reference may be made to Examples 2 to 8 and Comparative Example 2 which will be given later.

While measuring the electrolytic cell voltage, the measurement of the voltage drop in each portion in the electrolytic cell was done by means of a Luggin capillary. The potential of the perforated plate anode employed according to the method of the present invention was quite the same as that of the expanded metal anode. Thus, it was confirmed that the difference of electrolytic cell voltage was due only to the difference of voltage drop in the cation exchange membrane.

As is apparent from the FIGURE, as the total of the circumferential lengths of openings is increased, the voltage drop at the cation exchange membrane is decreased. When the total of the circumferential lengths of the openings of the perforated plate anode is 3 $m/dm^2$ or more, the voltage drop at the cation exchange membrane at the time when the perforated plate anode is used becomes smaller than that at the time when the expanded metal anode is used. When the total of the circumferential lengths of openings of the perforated plate anode is 4 $m/dm^2$ or more, even if the total of the circumferential lengths of openings is increased, the voltage drop at the cation exchange membrane does almost not change. But, in this case, a slight decrease of the voltage drop is observed. However, in this case, as compared with the voltage drop at the cation exchange membrane at the time when the expanded metal anode is used, the voltage drop at the cation exchange membrane at the time when the perforated plate anode is used is decreased by a difference as large as 0.15 to 0.2 V. This fact clearly shows that the current distribution in the cation exchange membrane becomes uniform and, hence, the voltage drop at the cation exchange membrane is decreased, thereby lowering the electrolytic cell voltage.

For increasing the total of the circumferential lengths of openings, it is preferred that many openings each having a small area be formed in the perforated plate anode. However, when the total of the circumferential lengths of openings is more than 20 $m/dm^2$, the mechanical strength of the perforated plate anode not only becomes low, but also, the working for attaining such a large value of the total of the circumferential lengths of openings is difficult to conduct, leading to practical disadvantages.

For making it possible to effect a stable electrolytic operation by removing the chlorine gas from the anode chamber behind the anode with respect to the position of the cathode, the opening rate of the perforated plate anode may be 10% or more, preferably 15% or more. On the other hand, too high an opening rate of the perforated plate anode leads to increase of the portions of the cation exchange membrane which are opposite to the openings and in which the current does not flow, thereby causing the effect of the present invention to be attenuated. For this reason, the opening rate may be 70% or less, preferably 60% or less. In other words, the opening rate may be 10 to 70% , preferably 15 to 60%. As long as the opening rate of the perforated plate is within the above-mentioned range, the voltage drop at the cation exchange membrane largely depends on the total of the circumferential lengths of openings, though it also slightly depends on the opening rate.

The perforated plate is generally produced by subjecting a plate to punching. Alternatively, the perforated plate may be produced by subjecting an expanded metal, which has been prepared from a plate, to pressing to have a flat shape. With respect to the shape of opening, any of shapes may be chosen in so far as the required total of the circumferential lengths of openings can be given and the punching working for forming such a shape can be easily done. In the case of openings having a circular shape which can be easily formed by punching, the preferred arrangement is such that the centers of openings are arranged at the apexes of equilateral triangles, namely, in 60°-zigzag configuration or the centers of openings are arranged at the apexes of right-angled triangles, namely, in 45°-zigzag configuration. For increasing the total of the circumferential lengths of openings, it is preferred that each opening have a small diameter. The openings each may independently have a diameter of 0.5 to 6 mm, preferably 1 to 5 mm. Further, for lowering the electrolytic voltage, it is effective to coarsen the surface of the anode positioned in adjacent relationship with the cation exchange membrane by sand blasting, chemical etching, mechanical grooving or the like.

The perforated plate may have such a thickness as will provide a sufficient mechanical strength not to largely deform the perforated plate when the cation exchange membrane is pressed against the perforated plate anode. The suitable thickness of the perforated plate may be 0.8 to 3 mm.

The substrate material of perforated plate may be any of those which are usually employed as an anode material for the electrolysis of an aqueous solution of an alkali metal chloride. Illustratively stated, examples of the substrate material include titanium, zirconium, tantalum, niobium and alloys thereof. As the active coating material for the anode, there may be employed coating materials which exhibit an anodic activity, for example, those composed mainly of a precious metal oxide such as ruthenium oxide or those composed of a precious metal or alloys thereof. To increase adhesion between the substrate and the anodic active coating material, degreasing, grinding and/or acid-treatment of the surface of the substrate may advantageously be conducted prior to coating the substrate with the anodically active coating material. With respect to a method for forming an anodically active coating on the substrate, there can be mentioned a method in which a chloride or the like of a precious metal is dissolved in an aqueous hydrochloric acid or an organic solvent and applied onto the surface of the substrate, followed by thermal decomposition, a method in which a coating of a precious metal is formed by electroplating or electroless plating and then subjected to heat treatment, a plasma melt spraying method, an ion plating method and the like.

In forming an anodically active coating on the surface of the perforated plate, it is preferred that the thickness of the coating of the perforated plate on its front surface and on the inner wall surfaces of the openings be larger than that of the coating of the perforated plate on its back surface. The term "front surface" of the perforated plate is used herein to mean the surface of the perforated plate anode to be positioned opposite to the cathode and in adjacent relationship with the cation exchange membrane, and the term "inner wall surface of the opening" means the surface in the opening which corresponds to the thickness of the perforated plate. The term "back surface" of the perforated plate means the surface of the perforated plate which is reverse to the above-mentioned front surface of the perforated plate.

Accordingly, in another aspect of the present invention, there is provided an anode for the electrolysis of an aqueous alkali metal chloride solution in an electrolytic cell partitioned by means of a cation exchange membrane into an anode chamber adapted to accomodate therein an anode and a cathode chamber adapted to accomodate therein a cathode, characterized in that the anode comprises a perforated plate having a plurality of openings and an anodically active coating formed on said perforated plate, the coating of the perforated plate anode on its front surface to be positioned opposite to a cathode and in adjacent relationship with a cation exchange membrane and on the inner wall surfaces of the openings having a thickness larger than that of the coating of the perforated plate on its back surface reverse to said front surface.

Generally, in the electrolysis of an aqueous alkali metal chloride solution by a cation exchange membrane process, the consumption of the anode at its face positioned in adjacent relationship with the cation exchange membrane rapidly progresses. In order to resolve the problem as mentioned above, it has been proposed to use an anode without an anodically active coating applied onto its front surface positioned in adjacent relationship with the cation exchange membrane but with an anodically active coating applied only onto its back surface reverse to said front surface, that is, only onto its surface positioned in remote relationship with the cation exchange membrane (see, for example, U.S. patent specification No. 4,100,050). As a result of the investigation of the present inventors, however, it has been revealed that when a perforated plate anode having, only on its back surface, an anodically active coating is used, the electrolytic voltage in the electrolysis of an aqueous alkali metal chloride solution disadvantageously becomes high.

As mentioned before, when the electrolysis is conducted using the perforated plate anode, the current readily flows to areas in the vicinity of the openings of the perforated plate. Further, within the areas in the vicinity of the openings, the current flow is most concentrated especially on the front surface and the inner wall surfaces of the openings of the perforated plate and, therefore, the rate of consumption of the anode at those surfaces is high as compared with that at the back surface of the perforated plate. With a view to eliminating the drawback, the present inventors have conducted research. As a result, it has been found that an anode which will provide a low electrolytic voltage and is excellent in durability can be obtained by making the thickness of the anodically active coating of the perforated plate anode on its front surface and on the inner wall surfaces of the openings (the anodically active coating on the above-mentioned surfaces bears a large part of the flowing current and plays an important role in making uniform the current distribution in the cation exchange membrane) larger than that of the coating of the perforated plate anode on its back surface.

In order to determine the rate of contribution of the coating on each of the front surface, inner wall surfaces of the openings and back surface of the perforated plate anode to making uniform the current distribution in the cation exchange membrane, the coating on each of two of the above-mentioned three surfaces of the perforated plate anode is scraped off while leaving the coating on the remaining one surface unremoved to produce three kinds of sample perforated plate anodes, and electrolysis was conducted using each of the samples.

To produce sample perforated plate anodes, each of three 1.2 mm-thick, 10 cm×10 cm titanium plates was subjected to punching to obtain a perforated plate in which circular openings each having a diameter of 2 mm were arranged in 60°-zigzag configuration with a pitch of 3.5 mm. Each of three samples was the same with respect to each area of the front surface, inner wall surfaces of the openings and back surface. The overall surface of the perforated plate anode was coated with ruthenium oxide to give a perforated plate anode. The electrolytic cell had a current-flowing area of 10 cm×10 cm. As the cation exchange membrane, there was employed Nafion 315 (trade name of a product of Du Pont Co., U.S.A.) in which a woven cloth of Teflon (trade name) was embedded. As the cathode, there was employed a mild steel-made expanded metal having a thickness of 1.5 mm. Into the anode chamber was supplied a 3 N aqueous sodium chloride solution having a pH value of 2 while supplying a 5 N aqueous sodium hydroxide solution into the cathode chamber. While maintaining the inner pressure of the cathode chamber at a level of 1 m, in terms of a height of water column, higher than that of the anode chamber, the electrolysis was conducted at a current density of 50 A/dm$^2$ and at 90° C.

In the meantime, an expanded metal having a short axis of 7 mm and a long axis of 12.7 mm was prepared from a titanium plate. The surface of the expanded metal so prepared was coated with ruthenium oxide, and used as an anode. Using the same cation exchange membrane as mentioned above, the electrolysis was conducted under the same conditions as mentioned above. Using the electrolytic voltage exhibited by the use of the above-mentioned expanded metal anode as a reference value, the lowering in electrolytic voltage in the case of each sample perforated plate anode as compared with the electrolytic voltage in the case of the expanded metal anode was measured. In the case of the sample anode in which only the coating on the front surface was let unremoved, the lowering in electrolytic voltage was 0.11 V. In the case of the sample anode in which only the coating on the inner wall surfaces of the openings is left unremoved, the lowering in electrolytic voltage was 0.06 V. In the case of the sample anode in which only the coating on the back surface is left unremoved, the lowering in electrolytic voltage was 0.03 V. From the above, it has surprisingly been found that, as compared with the coated expanded metal anode, the perforated plate anode having, even only on its back surface, an anodically active coating is effective for making uniform the current distribution in the cation exchange membrane, thereby lowering the electrolytic voltage. Further, the perforated plate anode having, only on the inner wall surfaces of the openings thereof, an anodically active coating and the perforated plate anode having, only on its front surface, an anodically active coating respectively exhibit electrolytic voltages which are further lowered in the above order, thereby making further uniform the current distribution in the cation exchange membrane accordingly. In the case of the perforated plate anode having an anodically active coating on the front surface, on the inner wall surfaces of the openings and on the back surface, the anodically active coatings on the above-mentioned three surfaces are believed to bear parts of the current which are increased in the above order, respectively. Furthermore, the electrolysis was conducted, using a perforated plate anode having on its overall surface an anodically active coating, under the conditions as mentioned above for six months, and the losses (consumed thicknesses) of the anodically active coatings on the respective surfaces were measured. The measurement showed that the loss ratio (front surface:inner walls of openings:back surface) was 2:1.4:1. The measurement of the loss was done as follows: using an X-ray microanalyzer ARL-EMX-SM-2 (trade name of an analyzer produced and sold by Shimadzu Seisakusho, Japan), the characteristic X-rays of Ru and Ti respectively in the anodically active coating and in the substrate were recorded on the chart, and from the chart, the ratio of the area of Ru to the area of Ti was obtained. Comparing the obtained ratio with the calibration curve obtained from the samples having known coating thicknesses, the thickness of the remaining anodically active coating was obtained, and the loss of the coating was calculated. The reason why the losses of the coating of the perforated plate anode on its front surface and on the inner wall surfaces of the openings thereof are larger than that of the coating of the perforated plate on its back surface is believed to be such that the current densities on the front surface and the inner wall surfaces of the openings are larger than that on the back surface, and the front surface and the inner wall surfaces of the openings are adjacent to the alkaline cation exchange membrane as compared with the back surface.

By making large the thickness of the anodically active coating of the perforated plate anode on its front surface and the inner wall surfaces of the openings which coating is effective for lowering the electrolytic voltage but readily undergoes consumption as compared with that on the back surface, such a great advantage can be obtained that there is provided a perforated plate anode having high durability and exhibiting low electrolytic voltage for a prolonged period of time.

With respect to the ratio of the thickness of the anodically active coating on the front surface and the inner wall surfaces of the openings to that on the back surface, since the rates of consumption of the coatings on the respective surfaces vary depending on the electrolytic conditions, it is preferred that the thicknesses of the coatings on the respective surfaces be appropriately chosen in accordance to the electrolytic conditions so that the coating on each surface may be lost simultaneously. The ratio is preferably 1.5 or more. Moreover, as described before, since the effect of the coating on the back surface for lowering the electrolytic voltage is small, the perforated plate anode of the present invention may be used without any anodically active coating applied onto the back surface of the perforated plate.

With respect to the method of obtaining a perforated plate anode having on its front surface and the inner wall surfaces of the openings a coating of a thickness larger than the thickness of the coating on the back surface, any method suitable for the purpose may be employed without any special restriction. For example, in the case of the method in which a coating is applied onto a perforated plate and then subjected to thermal decomposition, a coating may be applied only onto the front surface and the inner wall surfaces of the openings, followed by thermal decomposition. In the case of a plating method, there may be employed a method in which an opposite electrode is disposed only on the side of the front surface of a perforated plate or a method in which a plating operation is conducted until a coating of a desired thickness is formed on the back surface of a perforated plate and then an anti-plating coating is applied only onto the back surface, followed by a further plating operation.

As the electrolytic cell, there may preferably be employed a cell in which there are provided spacings behind the anode and the cathode, respectively so that the gas generated can readily escape (see, for example, Japanese Patent Application Laid-Open Specification No. 68477/1976). As the material for the cathode, there may be employed iron, stainless steel or nickel with or without a low hydrogen overvoltage substance coated thereon.

Further, for reducing the spacing between the cation exchange membrane and the anode to an extent as small as possible and for causing the chlorine gas generated on the anode to vigorously agitate the interface between the cation exchange membrane and the anode so that the thickness of the desalted layer can be reduced, it is preferred that the inner pressure of the cathode chamber be maintained at a level higher than that of the anode chamber. In order for the pressure not to be locally reversed even if there occurs a minute variation of pressure due to the generation of gas, it is preferred to maintain the inner pressure of the cathode chamber at a level of 0.2 m or more, in terms of a height of water column, higher than that of the anode chamber. On the other hand, however, too high an inner pressure of the cathode chamber occasionally tends to break the electrode and the cation exchange membrane and, hence, the pressure difference is preferably 5 m or less in terms of a height of water column.

The kind of cation exchange membrane to be employed in the method of the present invention is not critical. There can be used those which are generally employed in the electrolysis of an aqueous solution of an alkali metal chloride. As the ion exchange groups, there can be mentioned those of a sulfonic acid type, those of a carboxylic acid type and those of a sulfonic acid amide type. Any of them may be employed without any restriction, but there may most suitably be employed those of carboxylic acid type which are excellent in transport number of alkali metal ion or those of a combined type of carboxylic acid and sulfonic acid. In the latter case, it is preferred to dispose the cation exchange membrane in such a manner that the side on which the sulfonic acid groups are present is opposite to the anode while the side on which the carboxylic acid groups are present is opposite to the cathode. As the base resin, fluorocarbon type resins are excellent from a viewpoint of resistance to chlorine. Further, for the purpose of reinforcing the cation exchange membrane, the membrane may be provided with a backing of a cloth, net or the like.

In practicing the electrolysis according to the method of the present invention, the current density may be varied widely within the range of 1 to 100 A/dm$^2$. The concentration of an aqueous solution of an alkali metal chloride in the anode chamber may be varied widely within the range of 100 to 300 g/liter. Too low a concentration leads to various disadvantages such as elevation of electrolytic voltage, lowering of current efficiency and increase in the oxygen gas content of the chlorine gas. On the other hand, too high a concentration causes not only the alkali metal chloride content of the alkali metal hydroxide in the cathode chamber to be increased, but also the rate of utilization of an alkali metal chloride to be lowered. The more preferred range of the concentration of an aqueous solution of alkali metal chloride in the anode chamber is 140 to 200 g/liter. The pH value of the solution in the anode chamber may be varied widely within the range of 1 to 5. The concentration of an aqueous solution of an alkali metal hydroxide may be varied widely within the range of 10 to 45% by weight.

As described, according to the method of the present invention in which there is used a perforated plate anode, the electrolytic voltage is 0.15 to 0.2 V lower than that in the conventional method in which an expanded metal is used as an anode. The above-mentioned difference in electrolytic voltage between the present method and the conventional method is due only to the difference of voltage drop at the cation exchange membrane. As described before, according to the present invention, the lowering of the electrolytic cell voltage is attained by rendering the current distribution in the cation exchange membrane uniform by the use of a perforated plate anode.

Further, according to the present invention, the whole area of the cation exchange membrane is uniformly and effectively utilized, leading to the prolonged life of the cation exchange membrane. Furthermore, the interface of the cation exchange membrane on the side of the anode is vigorously agitated by the action of the chlorine gas generated on the anode to decrease the thickness of the desalted layer and, hence, the electrolytic operation can be stably conducted without occurrence of the so-called hydrolysis. Moreover, in case the coating of the perforated plate anode on its front surface and the inner wall surfaces of the openings has a thickness larger than that of the coating on the back surface, the perforated plate anode has high durability and exhibits low electrolytic voltage for a long time as compared with the perforated plate anode having, on each surface, a uniform-thick coating, even if the total of the amounts of coatings on the respective surfaces is the same. The above-mentioned effects can be especially remarkable when the electrolysis is conducted at a high current density while maintaining the inner pressure of the cathode chamber at a level higher than that of the anode chamber.

The present invention is further explained with reference to the following Examples, which should not be construed to be limiting the scope of the present invention.

EXAMPLE 1

A cation exchange membrane was prepared. Tetrafluoroethylene and perfluoro-3,6-dioxy-4-methyl-7-octenesulfonyl fluoride were copolymerized in 1,1,2-trichloro-1,2,2-trifluoroethane, using perfluoropropionyl peroxide as a polymerization initiator, at 45° C. while maintaining the pressure of the tetrafluoroethylene at 5 kg/cm$^2$-G. The resulting copolymer is referred to as "polymer (1)".

Substantially the same procedures as mentioned above were repeated except that the pressure of tetrafluoroethylene was maintained at 3 kg/cm$^2$-G. The resulting copolymer is referred to as "polymer (2)".

A part of each of these polymers was washed with water and then saponified, whereupon the equivalent weight of each polymer was measured by titration to give 1500 for the polymer (1) and 1110 for the polymer (2). The polymer (1) and polymer (2) were subjected to heat molding to give a two-layered laminate with the polymer (1) having a thickness of 50$\mu$ and with the polymer (2) having a thickness of 100$\mu$. A woven cloth of Teflon was embedded in the laminate on the side of the polymer (2) by a vacuum laminating method, and the laminate was then saponified to give a sulfonic acid type cation exchange membrane.

A 10 cm$\times$10 cm titanium plate having a thickness of 1.5 mm was subjected to punching to obtain a perforated plate in which circular openings each having a diameter of 2 mm were arranged in 60°-zigzag configuration with a pitch of 3.5 mm. The overall surface was coated with ruthenium oxide to give a perforated plate anode. The total of the circumferential lengths of openings of the anode was 5.9 m/dm$^2$. The opening rate was 30%. As the cathode, there was employed an ironmade expanded metal.

The electrolytic cell had a current-flowing area of 10 cm$\times$10 cm. The frame for the anode chamber was made of titanium while the frame for the cathode chamber was made of stainless steel. Behind the anode and the cathode which are opposite to each other were respectively provided 3 cm-spacings.

In the electrolytic cell, the cation exchange membrane is disposed in such a manner that the polymer (1) of the laminate is on the side of the cathode. Into the anode chamber was supplied a 3 N aqueous solution of sodium chloride having a pH value of 2 while supplying a 5 N aqueous solution of sodium hydroxide into the cathode chamber. At the same time, while maintaining the inner pressure of the cathode chamber at a level 1 m, in terms of a height of water column, higher than that of the anode chamber, the electrolysis was conducted at a current density of 50 A/dm$^2$ and at 90° C. The electrolytic voltage was 3.85 V. The measurement of the anode potential by means of a Luggin capillary gave 1.41 V vs normal hydrogen electrode. The voltage drop at the cation exchange membrane was stably 1.07 V. The current efficiency was 82%. The so-called hydrolysis began to occur at a current density of 100 A/dm$^2$.

COMPARATIVE EXAMPLE 1

An expanded metal having a short axis of 7 mm and a long axis of 12.7 mm was prepared from a titanium plate. The surface of the expanded metal so prepared was coated with ruthenium oxide, and used as an anode. Using the same cation exchange membrane as described in Example 1, the electrolysis was conducted under the same conditions as employed in Example 1. The electrolytic voltage was 4.05 V. The measurement of the anode potential gave 1.41 V vs normal hydrogen electrode. The voltage drop at the cation exchange membrane was 1.27 V. The current efficiency was 81.5%. The so-called hydrolysis began to occur at a current density of 70 A/dm$^2$.

EXAMPLES 2 to 8 and COMPARATIVE EXAMPLE 2

A cation exchange membrane was prepared as follows. In substantially the same manner as described in Example 1, tetrafluoroethylene and perfluoro-3,6-dioxy-4-methyl-7-octenesulfonyl fluoride were copolymerized to obtain "polymer (1')" having an equivalent weight of 1350 and "polymer (2')" having an equivalent weight of 1090. The polymer (1') and polymer (2') were subjected to heat molding to give a two-layered laminate with the polymer (1') having a thickness of 35$\mu$ and with the polymer (2') having a thickness of 100$\mu$. A woven cloth of Teflon was embedded in the laminate on the side of the polymer (2') by a vacuum laminating method, and the laminate was then saponified to give a sulfonic acid type cation exchange membrane. Only the surface of the polymer (1') of the membrane was subjected to reducing treatment to convert the sulfonic acid groups to carboxylic acid groups [the treated surface is referred to as "surface (A)"].

A 10 cm×10 cm titanium plate having a thickness of 1.0 mm was subjected to punching to obtain a perforated plate in which circular openings were arranged in 60°-zigzag configuration with variation of other characteristics as indicated in Table 1. The overall surface of the perforated plate was coated with ruthenium oxide to give a perforated plate anode.

In the electrolytic cell, the cation exchange membrane is disposed in such a manner that the surface (A) of the laminate is on the side of the cathode. Using the same electrolytic cell as described in Example 1, the electrolysis was conducted in the same manner as described in Example 1.

The electrolytic voltage and the voltage drop were measured. Results are shown in Table 1.

Further, with respect to a perforated plate anode of 60°-zigzag configuration in which, however, the total of the circumferential lengths of openings is lower than 3 m/dm$^2$, and with respect to the same expanded metal anode as used in Comparative Example 1, the electrolyses were conducted for the purpose of comparison. Results are also shown in Table 1.

TABLE 1

| | Type of anode | Opening diameter × pitch, mm × mm | Total of circumferential lengths, m/dm$^2$ | Opening rate, % | Electrolytic voltage, V | Voltage drop at cation exchange membrane, V |
|---|---|---|---|---|---|---|
| Example 2 | 60°-zigzag perforated plate | 5 × 7 | 3.7 | 46 | 3.92 | 1.14 |
| Example 3 | 60°-zigzag perforated plate | 3 × 5 | 4.3 | 33 | 3.89 | 1.11 |
| Example 4 | 60°-zigzag perforated plate | 1.5 × 3 | 6.0 | 22 | 3.88 | 1.10 |
| Example 5 | 60°-zigzag perforated plate | 3 × 4 | 6.7 | 50 | 3.88 | 1.10 |
| Example 6 | 60°-zigzag perforated plate | 2 × 3 | 8.0 | 40 | 3.86 | 1.08 |
| Example 7 | 60°-zigzag perforated plate | 3 × 10 | 1.1 | 8 | 5.50 | 2.60 |
| Example 8 | 60°-zigzag perforated plate | 7 × 9.5 | 2.7 | 49 | 4.09 | 1.31 |
| Comparative Example 2 | Expanded metal | Short axis × Long axis 7 × 12.7 | | | 4.05 | 1.27 |

EXAMPLES 9 to 11 and COMPARATIVE EXAMPLE 3

A cation exchange membrane was prepared as follows. Tetrafluoroethylene and $CF_2{=}CFO(CF_2)_3COOCH_3$ were copolymerized to obtain a copolymer having an equivalent weight of 650 in the form of a film having a thickness of 250μ. A woven cloth of Teflon was embedded in the film by a heat-press laminating method, and the film was then subjected to hydrolysis to give a carboxylic acid type cation exchange membrane.

A 10 cm×10 cm titanium plate having a thickness of 1.0 mm was subjected to punching to obtain a perforated plate in which circular openings were arranged in 45°-zigzag configuration. In the same manner as mentioned above, there was obtained a perforated plate in which rectangular openings are arranged in lattice configuration. Further, there was obtained a perforated plate by roll-pressing the same expanded metal as used in Comparative Example 1 into a flat shape. The surface of each of the above-mentioned perforated plates was coated with ruthenium oxide. The same expanded metal anode as used in Comparative Example 1 was also used.

Using the above-mentioned cation exchange membrane and the above-mentioned anodes, the electrolyses were conducted, in the same manner as described in Example 1, in the same electrolytic cell as described in Example 1. In Examples 9 to 11 and Comparative Example 3, the current density was 20 A/dm$^2$. The pH value of an aqueous solution of sodium chloride was 3, and the concentration of an aqueous solution of sodium hydroxide was 13 N. Results are shown in Table 2.

TABLE 2

| | Type of anode | Openings, mm | Total of circumferential lengths, m/dm$^2$ | Opening rate, % | Electrolytic Voltage, V |
|---|---|---|---|---|---|
| Example 9 | 45°-zigzag perforated plate | Opening diameter × pitch 2 mm × 4 mm | 4.5 | 40 | 3.62 |
| Example 10 | Rectangular opening-perforated plate | Length × width × pitch 3 mm × 3 mm × 5 mm | 5.9 | 44 | 3.63 |

TABLE 2-continued

| | Type of anode | Openings, mm | Total of circumferential lengths, m/dm$^2$ | Opening rate, % | Electrolytic Voltage, V |
|---|---|---|---|---|---|
| Example 11 | Plate obtained by pressing the expanded metal | Short axis × long axis 6.2 mm × 13.2 mm | 5.2 | 50 | 3.68 |
| Comparative Example 3 | Expanded metal | Short axis × long axis 7 mm × 12.7 mm | | | 3.75 |

EXAMPLES 12 and 13

A perforated plate anode was prepared as follows. A 10 cm×10 cm titanium plate having a thickness of 1.0 mm was subjected to punching to obtain a perforated plate in which circular openings each having a diameter of 2 mm were arranged in 60°-zigzag configuration with a pitch of 3.0 mm. The perforated plate was degreased with a commercially available polishing powder, and then immersed in a 20 wt % aqueous sulfuric acid at 85° C. for 3 hours to coarsen the surface of the perforated plate. A ruthenium trichloride solution having a ruthenium concentration of 40 g/liter which had been prepared by dissolving ruthenium trichloride in a 10% aqueous hydrochloric acid solution was applied onto the front surface and inner wall surfaces of the openings of the perforated plate by brushing, and then baked at 450° C. for 5 minutes in air. This coating and baking operation was repeated 7 times. No coating was applied onto the back surface. The thickness of the coating on the front surface and the inner wall surfaces of the openings of the perforated plate was about 1.9μ. In Example 13, the coating and baking operation was repeated 5 times. In the first two-time operations, the whole surface of the perforated plate was coated, while, in the next three-time operations, only the front surface and the inner wall surfaces of the perforated plate were coated. The thickness of the coating on the front surface and the inner wall surfaces of the openings was about 1.6μ, while the thickness of the coating on the back surface was about 0.6μ. In both Examples 12 and 13, the total amount of coating was the same and about 190 mg. When no coating was applied onto the back surface, the back surface was swabbed with a gauze impregnated with carbon tetrachloride having 1 wt % of rape oil dissolved therein and then, a coating was applied onto the front surface and the inner wall surfaces of the openings. In both Examples 12 and 13, the coated perforated plate was finally subjected to heat treatment at 500° C. for 3 hours in air.

A cation exchange membrane was prepared. Tetrafluoroethylene and perfluoro-3,6-dioxy-4-methyl-7-octenesulfonyl fluoride were copolymerized in 1,1,2-trichloro-1,2,2-trifluoroethane, using perfluoropropionyl peroxide as a polymerization initiator, to obtain "polymer (1")" having an equivalent weight of 1350 and "polymer (2")" having an equivalent weight of 1090. These equivalent weights were measured by washing a part of each of the polymers with water and then saponifying it, followed by titration. The polymer (1") and polymer (2") were subjected to heat molding to give a two-layered laminate with the polymer (1") having a thickness of 35μ and with the polymer (2") having a thickness of 100μ. A woven cloth of Teflon was embedded in the laminate on the side of the polymer (2") by a vacuum laminating method, and the laminate was then saponified to give a sulfonic acid type cation exchange membrane. Only the surface of the polymer (1") of the membrane was subjected to reducing treatment to convert the sulfonic acid groups to carboxylic acid groups [there was obtained a surface (A)].

The electrolytic cell had a current-flowing area of 10 cm×10 cm. The frame for the anode chamber was made of titanium while the frame for the cathode chamber was made of stainless steel. Behind the anode and the cathode which are opposite to each other were respectively provided 3 cm-spacings.

In the electrolytic cell, the cation exchange membrane is disposed in such a manner that the polymer (1") [surface (A)] of the laminate is on the side of the cathode. Into the anode chamber was supplied a 3 N aqueous solution of sodium chloride having a pH value of 2 while supplying a 5 N aqueous solution of sodium hydroxide into the cathode chamber. At the same time, while maintaining the inner pressure of the cathode chamber at a level of 1 m, in terms of a height of water column, higher than that of the anode chamber, the electrolysis was conducted at a current density of 50 A/dm$^2$ and at 90° C. In Examples 12 and 13, the electrolyses were conducted stably at an electrolytic voltage of 3.88 to 3.92 V and at an electrolytic voltage of 3.85 to 3.90 V, respectively. In Examples 12 and 13, 15 months after the start of the electrolysis and 16 months after the start of the electrolysis, respectively, the electrolytic voltages began to rise and, at the same time, the potentials of the anodes also began to rise, that is, the above-mentioned periods of time were lives of the anodes.

COMPARATIVE EXAMPLES 4 and 5

Perforated plates were prepared in the same manner as in Example 12. In Comparative Example 4, only the back surface of the perforated plate was coated 4 times to obtain a coating having a thickness of about 4.5μ. In Comparative Example 5, the whole surface of the perforated plate was coated 4 times to obtain coatings having the same thickness at the respective surfaces. In both Comparative Examples 4 and 5, the total amount of coating was the same and was about 190 mg. Each of the coated perforated plates was subjected to heat treatment at 500° C. for 3 hours in air to obtain an anode.

Using the same cation exchange membrane and the same electrolytic cell as in Example 12, the electrolyses were conducted in the same manner as in Example 12. In Comparative Example 4, the electrolytic voltage is as extremely high as 4.02 V. In Comparative Example 5, the electrolytic voltage was 3.85 to 3.90 V stably at the initial stage, but 13 months after the start of the electrolysis, the electrolytic voltage and the anode potential began rise, showing the end of the life.

EXAMPLE 14

A 10 cm×10 cm titanium plate having a thickness of 1.0 mm was subjected to punching to obtain a perforated plate in which circular openings having a diameter of 2 mm were arranged in 45°-zigzag configuration with a pitch of 4 mm. The perforated plate was subjected to pre-treatment in the same manner as in Example 12. A ruthenium trichloride solution having a ruthenium concentration of 40 g/liter which had been prepared by dissolving ruthenium trichloride in ethyl alcohol, followed by addition of 10 wt % of commercially available ethyl cellulose as a thickener was applied onto the front surface and inner wall surfaces of the openings of the perforated plate by brushing, and then baked at 450° C. for 5 minutes in air. This coating and baking operation was repeated 5 times. The back surface of the perforated plate was coated only in the first one-time operation. The thickness of the coating on the front surface and the inner wall surfaces of the openings was about 1.7μ, while the thickness of the coating on the bak surface was about 0.35μ. The total amount of coating was the same and about 190 mg. The coated perforated plate thus prepared was finally subjected to heat treatment at 500° C. for 3 hours.

A cation exchange membrane was prepared as follows. Tetrafluoroethylene and $CF_2{=}CFO(CF_2)_3COOCH_3$ were copolymerized to obtain a copolymer having an equivalent weight of 650 in the form of a film having a thickness of 250μ. A woven cloth of Teflon was embedded in the film by a heat-press laminating method, and the film was then subjected to hydrolysis to give a carboxylic acid type cation exchange membrane.

Using the above-mentioned cation exchange membrane and the above-mentioned anodes, the electrolysis was conducted, in the same manner as described in Example 12, in the same electrolytic cell as described in Example 12. In Example 14, the current density was 20 A/dm$^2$. The pH value of an aqueous solution of sodium chloride was 3, and the concentration of an aqueous solution of sodium hydroxide was 13 N. The electrolytic voltage was 3.60 to 3.65 V stably. 23 Months after the start of the electrolysis, the electrolytic voltage and the anode potential began to rise.

COMPARATIVE EXAMPLE 6

A perforated plate was prepared and subjected to pretreatment in the same manner as in Example 14. The same coating solution as used in Example 14 was applied twice to each of the front surface, the inner wall surfaces and the back surface of the perforated plate. The total amount of coating was the same as in Example 14 and about 190 mg. The thickness of the coating on each of the surfaces was 1.35μ. Using the cation exchange membrane as used in Example 14, the electrolysis was conducted under the same conditions as in Example 14. The electrolytic voltage was 3.60 to 3.65 at the initial stage, but 18 months after the start of the electrolysis, the electrolytic voltage and the anode potential began to rise.

What is claimed is:

1. A method for the electrolysis of an aqueous solution of an alkali metal chloride in an electrolytic cell partitioned by means of a cation exchange membrane into an anode chamber adapted to accomodate therein an anode and a cathode chamber adapted to accomodate therein a cathode, the improvement which comprises: using a flat perforated plate anode in the anode chamber wherein the value obtained by dividing the total of the circumferential lengths of the openings formed in the perforated plate anode at the portion opposite to the cation exchange membrane by the total area of said portion including the area of said openings is 3 m/dm$^2$ or more.

2. A method according to claim 1, wherein the value obtained by dividing the total of the circumferential lengths of the openings formed in the perforated plate anode at the portion opposite to the cation exchange membrane by the total area of said portion including the area of said openings is 4 to 20 m/dm$^2$.

3. A method according to claim 1 or 2, wherein the electrolysis is conducted while maintaining the inner pressure of the cathode chamber at a level higher than that of the anode chamber.

4. A method according to claim 1 or 2, wherein the proportion of the total area of openings of the perforated plate anode at the portion opposite to the cation exchange membrane in the total area of said portion including the total area of the openings is 10 to 70%.

5. A method according to claim 1 or 2, wherein said perforated plate anode has openings arranged in zigzag configuration.

6. A method according to claim 5, wherein said openings each independently have a diameter of 1 to 5 mm.

7. A method according to claim 3, wherein the inner pressure of the cathode chamber is maintained at a level of 0.2 to 5 m, in terms of a height of water column, higher than that of the anode chamber.

8. In an electrolytic cell for the electrolysis of an aqueous alkali metal chloride solution partitioned by means of a cation exchange membrane into an anode chamber adapted to accomodate therein an anode and a cathode chamber adapted to accomodate therein a cathode, the improvement which comprises: an anode comprising a flat perforated plate having a plurality of openings therein, said anode having a front surface adjacent to said membrane, a back surface opposite to said membrane and inner wall surfaces on the inner walls of said openings, and an anodically active coating formed on said front surface and on said inner wall surfaces, said back surface not having an anodically active coating or having an anodic coating of less thickness than the anodic coating on said front surface and said inner wall surfaces.

9. An electrolytic cell according to claim 8, wherein said cathode chamber has an inner pressure higher than that of said anode chamber.

10. An electrolytic cell according to claim 8, wherein the ratio of the thickness of the anodically active coating on the front surface and the inner wall surfaces of the openings to the thickness of the back surface is 1.5 or more.

11. An electrolytic cell according to claim 8, wherein said back surface of said anode does not have an anodically active coating.

12. In a method for the electrolysis of an aqueous alkali metal chloride solution in an electrolytic cell partitioned by means of a cation exchange membrane into an anode chamber adapted to accomodate therein an anode and a cathode chamber adapted to accomodate therein a cathode, the improvement which comprises: using a flat perforated plate anode having a plurality of openings therein, said anode having a front surface adjacent to said membrane, a back surface opposite to said membrane and inner wall surfaces on the inner walls of said openings and an anodically active coating formed on said front surface and on said inner wall surfaces, said back surface not having an anodically active coating or having an anodically active coating of less thickness than the anodically active coating on said front surface and said inner wall surfaces, wherein the value obtained by dividing the total of the circumferential lengths of the openings formed in the perforated plate anode at the portion opposite to the cation exchange membrane by the total area of said portion including the area of said openings is 3 $m/dm^2$ or more.

13. A method according to claim 12, wherein the value obtained by dividing the total of the circumferential lengths of the openings formed in the perforated plate anode at the portion opposite to the cation exchange membrane by the total area of said portion including the area of said openings is 4 to 20 $m/dm^2$.

14. A method according to claim 12, wherein the proportion of the total area of openings of the perforated plate anode at the portion opposite to the cation exchange membrane in the total area of said portion including the total area of the openings is 10 to 70%.

15. A method according to claim 12, wherein said openings each independently have a diameter of 1 to 5 mm.

16. A method according to claim 12, wherein the ratio of the thickness of the anodically active coating on the front surface and the inner wall surfaces of the openings to the thickness of the back surface is 1.5 or more.

17. A method according to claim 12, wherein said back surface of said anode does not have an anodically active coating.

18. A method according to claim 1, wherein said anode is produced by subjecting a plate to punching.

19. A method according to claim 1, wherein said anode is produced by subjecting an expanded metal, which has been prepared from a plate, to pressing to have a flat shape.

* * * * *